US008909082B2

(12) United States Patent
Murayama

(10) Patent No.: US 8,909,082 B2
(45) Date of Patent: Dec. 9, 2014

(54) IMAGE FORMING APPARATUS

(71) Applicant: Canon Kabushiki Kaisha, Tokyo (JP)

(72) Inventor: Tatsuomi Murayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 13/727,992

(22) Filed: Dec. 27, 2012

(65) Prior Publication Data

US 2013/0195486 A1 Aug. 1, 2013

(30) Foreign Application Priority Data

Feb. 1, 2012 (JP) ..... 2012-019707
Dec. 20, 2012 (JP) ..... 2012-277996

(51) Int. Cl.
*G03G 15/16* (2006.01)
*G03G 15/00* (2006.01)
*G03G 13/16* (2006.01)

(52) U.S. Cl.
CPC ..... *G03G 13/16* (2013.01); *G03G 15/1675* (2013.01); *G03G 15/1605* (2013.01); *G03G 15/50* (2013.01); *G03G 15/5004* (2013.01)
USPC ..... 399/66; 399/82; 399/85

(58) Field of Classification Search
CPC ..... G03G 15/1675; G03G 15/167; G03G 15/1665
See application file for complete search history.

(56) References Cited

U.S. PATENT DOCUMENTS

| | | | | |
|---|---|---|---|---|
| 6,026,257 | A * | 2/2000 | Takami et al. | 399/66 |
| 6,205,299 | B1 * | 3/2001 | Kusaka et al. | 399/45 |
| 7,538,918 | B2 * | 5/2009 | Oki | 358/521 |
| 2008/0118259 | A1 * | 5/2008 | Yamada | 399/66 |
| 2009/0080923 | A1 * | 3/2009 | Murayama | 399/66 |

FOREIGN PATENT DOCUMENTS

| | | | |
|---|---|---|---|
| JP | 5-6112 | A | 1/1993 |
| JP | 2006-91481 | A | 4/2006 |
| JP | 2007-316217 | A | 12/2007 |
| JP | 2008-139539 | A | 6/2008 |
| JP | 2009-251171 | A | 10/2009 |

* cited by examiner

*Primary Examiner* — Clayton E LaBalle
*Assistant Examiner* — Ruifeng Pu
(74) *Attorney, Agent, or Firm* — Fitzpatrick, Cella, Harper & Scinto

(57) ABSTRACT

An image forming apparatus includes: an image bearing member; an image forming portion; an intermediary transfer member; a transfer member; an executing portion capable of executing a first mode in which a transfer voltage based on a current detected when a predetermined voltage is applied to the transfer member is applied to the transfer member and capable of executing a second mode in which a transfer voltage is applied to the transfer member to provide a predetermined constant-current; and a controller enabling transition between a stand-by state where the image formation is enabled and a sleep state less than in power consumption than the stand-by state. The controller executes the first mode in a job after main switch actuation and before the transition to the sleep state, and executes the second mode in an initial job after the transition from the sleep state to the stand-by state.

4 Claims, 9 Drawing Sheets

IMAGE FORMING APPARATUS

FIELD OF THE INVENTION AND RELATED ART

The present invention relates to a transfer voltage control of an image forming apparatus for transferring a toner image by applying a transfer voltage to a transfer portion.

The image forming apparatus in which the toner image formed on an image bearing member is transferred onto a recording material directly or via an intermediary transfer member and then the recording material on which the toner image is transferred is heated and pressed by a fixing device to fix the image thereon has been widely used. The transfer portion where the toner image carried on the image bearing member is transferred onto the recording material or the intermediary transfer member is generally formed by bringing a transfer member into contact with the image bearing member. By applying the transfer voltage to the transfer member, the toner image is transferred from the image bearing member onto the recording material or the intermediary transfer member which passes through the transfer portion.

In the case where the toner image is transferred by using the transfer member, there is a need to ensure a transfer current, in a proper range, passing through the transfer portion via the transfer member. When the transfer current is below the proper range, the toner carried on the image bearing member cannot be transferred sufficiently, so that a transfer efficiency is lowered. However, when the transfer current exceeds the proper range, the toner transferred from the image bearing member is polarity-inverted at a portion where the toner is transferred to increase a proportion of the toner moved back to the image bearing member, so that the transfer efficiency is also lowered. Further, the transfer member is fluctuated in resistance value with an embodiment temperature or a cumulative energization time in general and therefore the voltage to be applied to the transfer member is required to be adjusted always depending on the resistance value of the transfer member.

As a method of setting the transfer current passing through the transfer portion via the transfer member within the proper range, constant current control and active transfer voltage control (ATVC) have been put into practical use. In the constant current control, a transfer voltage subjected to the constant current control with a predetermined current value is applied to the transfer member to transfer the toner image. In the ATVC, a predetermined constant voltage is applied to the transfer member in a non-image forming state to measure a transfer current and thereafter a constant transfer voltage on the basis of a measurement result is applied to the transfer portion to transfer the toner image (Japanese Laid-OPen Patent Application (JP-A) Hei 05-006112).

JP-A Hei 05-006112, a current detecting circuit is connected with the transfer member and the image formation is stopped every image forming job of a predetermined number of sheets, and then the transfer current passing through the transfer portion is measured by applying constant voltages of a plurality of levels to the transfer member. Then, voltage-current data of a plurality of levels are subjected to interpolation computing (operation), so that the transfer voltage as the constant voltage is set so as to provide a center value, of a transfer current range, at the transfer efficiency is high.

The image forming apparatus automatically stops a rotation operation, a heating operation and voltage application at respective portions when a time period in which the image forming job is not performed exceeds a predetermined time, so that transition of its state to a sleep state in which electric power is lowered is made to save the electric power. Then, in the sleep state, when input of the image forming job or a restoring operation is performed at an operating portion, the state of the image forming apparatus is shifted from the sleep state to a stand-by state, so that the ATVC is effected. This is because there is a possibility that the resistance value of the transfer member is changed during the sleep state and thus the transfer voltage necessary to obtain a proper transfer current is changed.

However, when the ATVC is executed, a developing device is actuated to stir a developer and therefore a deterioration of the developer is excessively advanced correspondingly to a time necessary for the ATVC. Further, during the execution of the ATVC, the image formation cannot be started and therefore a first copy time which is a time from a command for image formation until a first print is outputted becomes long.

In recent years, a use of the image forming apparatus is enlarged, so that the image forming apparatus using the toner image is employed in even a domestic facsimile machine such that printing of only one sheet is effected by daily transition from the sleep state to the stand-by state. In such a case, in order to maintain an image quality, during the transition from the sleep state to the stand-by state, there is a need to optimally adjust the transfer current. However, it is desired to avoid that the image forming apparatus is kept waiting for the printing by the execution of the ATVC every transition from the sleep state to the stand-by state.

SUMMARY OF THE INVENTION

A principal object of the present invention is to provide an image forming apparatus having solved the above-described problem.

According to an aspect of the present invention, there is provided an image forming apparatus comprising: a rotatable image bearing member; a toner image forming portion for forming a toner image on the image bearing member; an intermediary transfer member rotatable in contact with the image bearing member; a transfer member for transferring the toner image from the image bearing member onto the intermediary transfer member at a transfer portion; an executing portion capable of executing an operation in a first mode in which a transfer voltage on the basis of a current detected when a predetermined voltage is applied to the transfer member at predetermined timing in advance of image formation is applied to the transfer member to effect the image formation, and capable of executing an operation in a second mode in which a transfer voltage is applied to the transfer member so as to provide a predetermined constant current value to effect the image formation; and a controller capable of making transition of a state of the image forming apparatus between a stand-by state in which the image formation is enabled and a sleep state in which electric power consumption is less than that in the stand-by state, wherein the controller executes the operation in the first mode in an image forming job after main switch actuation of a main assembly of the image forming apparatus and before the controller makes the transition of the state to the sleep state, and executes the operation in the second mode in an initial image forming job after the transition from the sleep state to the stand-by state.

In the image forming apparatus of the present invention, in an image forming job executed during the transition from the sleep state to the stand-by state, the operation in the second mode is executed to form the toner image on the intermediary transfer member and therefore the execution of the ATVC every transition from the sleep state to the stand-by state is eliminated. The transfer voltage subjected to the constant current control at a current value of an optimum transfer current is applied to the transfer portion and therefore even in the case where the resistance of the transfer member is largely changed during the sleep state, a substantially optimum transfer current is ensured, so that the toner image is transferred with a high quality.

Therefore, even when the ATVC is not executed during the transition from the sleep state to the stand-by state, the transfer voltage is property set, so that a high-quality print can be quickly outputted.

These and other objects, features and advantages of the present invention will become more apparent upon a consideration of the following description of the preferred embodiments of the present invention taken in conjunction with the accompanying drawings.

Figure 8:
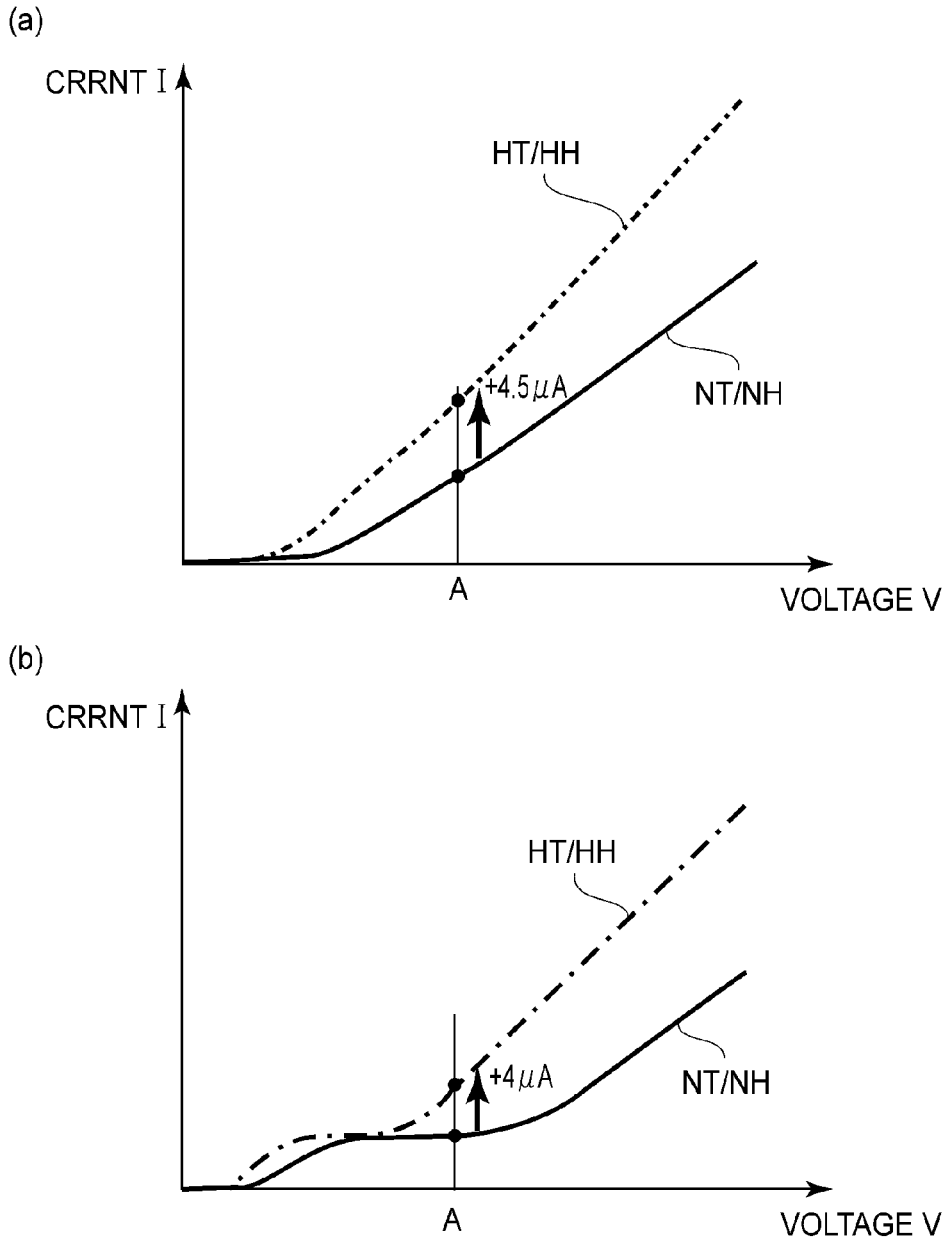

Parts (a) and (b) of FIG. 8 are illustrations of a change in transfer current with a change in ambient temperature and humidity.

Figure 9:
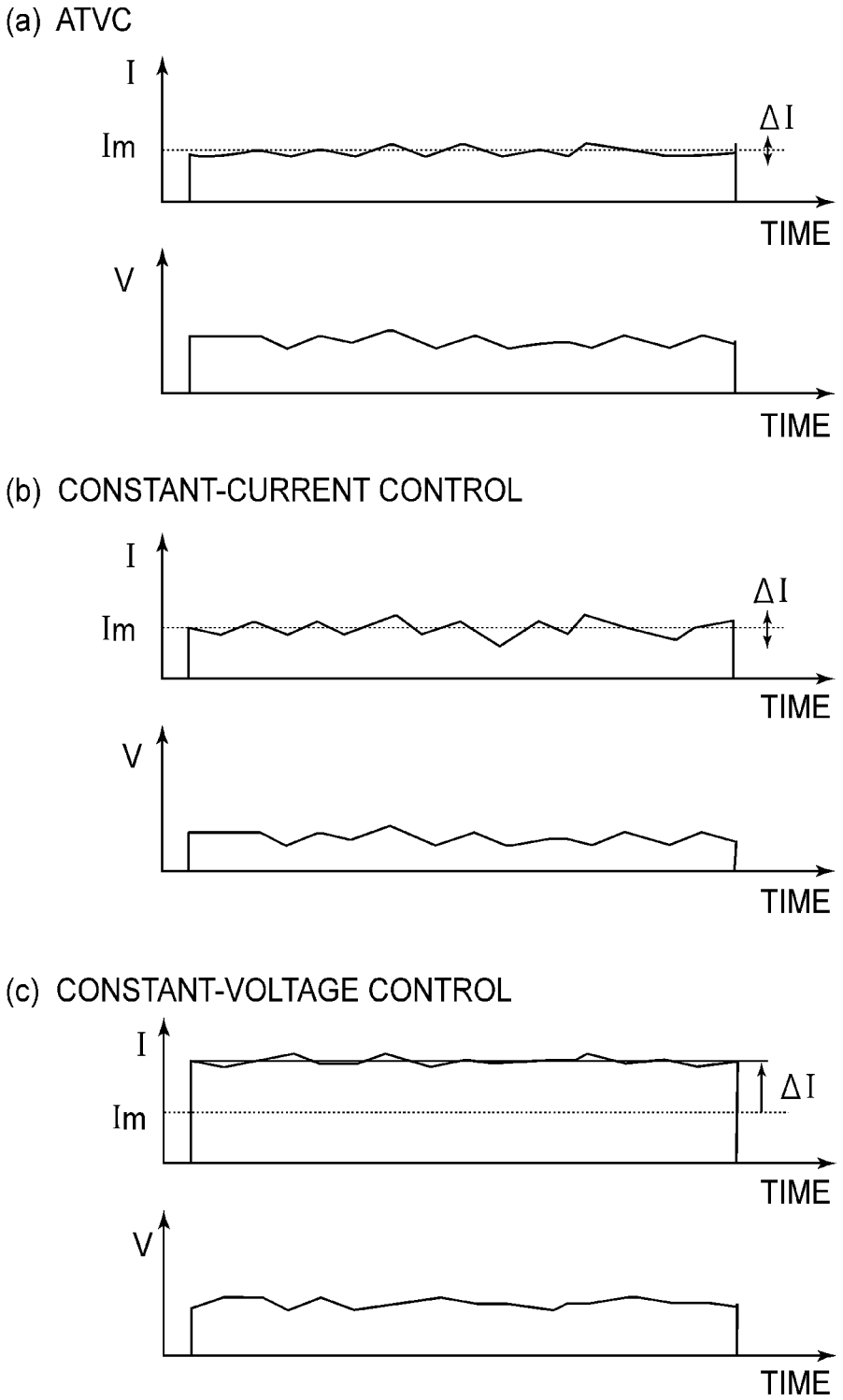

Parts (a), (b) and (c) of FIG. 9 are illustrations of optimization of a transfer current by constant current control.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as initial toner image transfer after transition from a sleep state to a stand-by state is executed by using a transfer voltage subjected to constant current control.

With respect to dimensions, materials, shapes, relative arrangements, and the like of constituent elements described in the following embodiments, the scope of the present invention is not limited only to those unless otherwise specified.

The image forming apparatus of the present invention can be carried out irrespective of type of, full-color/monochromatic, one-drum/tandem, one-component developer/two-component developer, direct transfer/intermediary transfer, charging, exposure, fixing photosensitive member, and the like.

In the following embodiments, only a principal portion concerning formation/transfer of the toner image will be described but the present invention can be carried out in image forming apparatuses for various uses including printers, various printing machines, copying machines, facsimile machines, multi-function machines, and so on by adding necessary equipment, options, or casing structures.

<Image Forming Apparatus>

Figure 1:
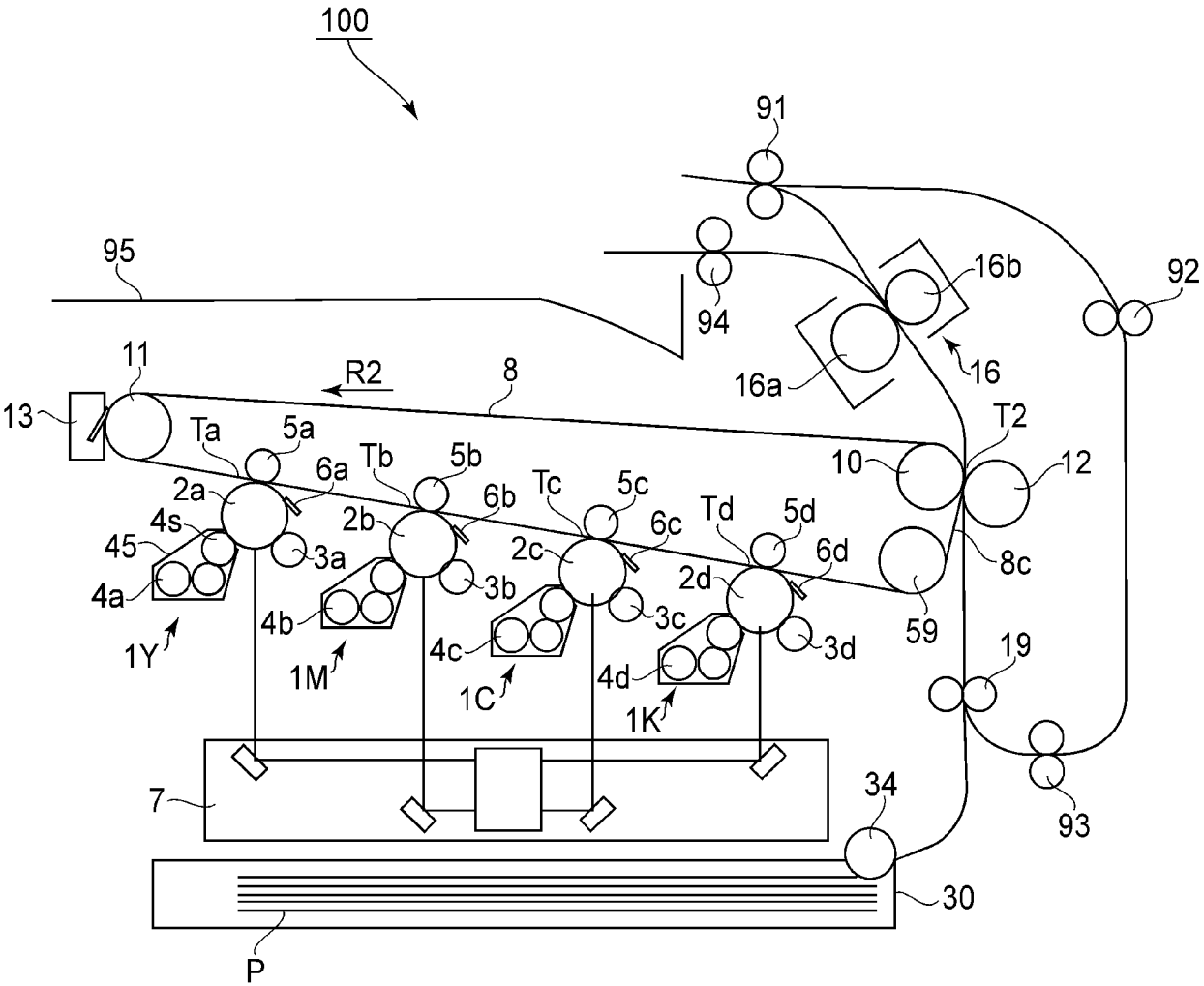
FIG. 1 is an illustration of a structure of an image forming apparatus.

FIG. 1 is an illustration of a structure of an image forming apparatus.

As shown in FIG. 1, an image forming apparatus 100 in this embodiment is a tandem and intermediary transfer type full-color printer in which image forming portions 1Y, 1M, 1C and 1K are arranged along a lower surface of an intermediary transfer belt 8.

At the image forming portion 1Y, a yellow toner image is formed on a photosensitive drum 2*a* and then is primary-transferred onto the intermediary transfer belt 8. At the image forming portion 1M, a magenta toner image is formed on a photosensitive drum 2*b* and is primary-transferred onto the intermediary transfer belt 8. At the image forming portions 1C and 1K, a cyan toner image and a black toner image are formed on photosensitive drums 2*c* and 2*d*, respectively, and are successively primary-transferred onto the intermediary transfer belt 8.

The four color toner images transferred on the intermediary transfer belt 8 are conveyed to a secondary transfer portion T2 and then are collectively secondary-transferred onto a recording material P. A separation roller 34 separates the recording material P, one by one, pulled out from a recording material cassette 30 and then sends the recording material P to a registration roller pair 19. The registration roller pair 19 receives the recording material P in a rest state and keeps the recording material P waiting, and then sends the recording material P to the secondary transfer portion T2 by timing the recording material P to the toner images on the intermediary transfer belt 8. The toner images carried on the intermediary transfer belt 8 are secondary-transferred onto the recording material P nip-conveyed through the secondary transfer portion.

The recording material P on which the four color toner images are transferred is heated and pressed at a heating nip of a fixing device 16, so that the toner image are fixed on the surface of the recording material P. Thereafter, the recording material P is discharged onto a tray 95 via a discharging roller 94. The fixing device 16 includes a fixing roller 16*a* and a pressing roller 16*b* press-controlled to the fixing roller 16*a* to form the heating nip of the recording material P.

The image forming portions 1Y, 1M, 1C and 1K have the substantially same constitution except that the colors of toners of yellow, cyan, magenta and black used in developing devices 4*a*, 4*b*, 4*c* and 4*d* are different from each other. In the following description, the image forming portion 1Y for yellow will be described and with respect to other image forming portions 1M, 1C and 1K, the suffix a of reference numerals (symbols) for representing a different in color is to be read as b, c and d, respectively, for explanation of associated ones of the constituent members.

The image forming portions 1Y includes the photosensitive drum 2*a* as an example of an image bearing member. Around the photosensitive drum 2*a*, a charging roller 3*a*, an exposure device 7, the developing device 4*a*, a primary transfer roller 5*a*, and a drum cleaning device 6*a* are disposed. The photosensitive drum 2*a* is constituted by an aluminum cylinder on which a photosensitive layer of an organic photoconductor (OPC) is formed and is rotated in an arrow R1 direction at a predetermined process speed.

To the charging roller 3*a* which is rotated by the photosensitive drum 2*a* in contact with the photosensitive drum 2*a*, an oscillating voltage in the form of a DC voltage based with an AC voltage is applied, so that the surface of the photosensitive drum 2*a* is electrically charged to a negative dark portion potential VD. The exposure device 7 outputs laser light with an exposure signal obtained by developing image data onto scanning lines and by subjecting the developed image data to pulse width modulation and exposes the photosensitive drum 2*a* to the laser light by scanning of the laser light through a rotating mirror. A laser light source of the exposure device 7 emits the laser light correspondingly to a time-series electric digital pixel signal of image information. The potential of a portion of the surface of the photosensitive drum 2*a* subjected to the exposure to the laser light is lowered to a light portion potential VL, so that the toner can be deposited on the surface of the photosensitive drum 2*a*.

The developing device 4*a* stirs a developer containing the toner and a carrier to electrically charges the developer, and carries the developer on a rotating developing sleeve 4*s* to supply the toner to the photosensitive drum 2*a*. To the developing sleeve 4*s*, an oscillating voltage in the form of a negative (−) DC voltage Vdc biased with an AC voltage is applied, so that the toner is transferred onto the portion of the photosensitive drum 2*a* subjected to the exposure to form the image. The toner in an amount corresponding to consumption by the image formation is replenished from an unshown developer supplying device to the developing device 4*a*, so that a state of the developer in the developing device 4*a* is kept constant.

To the primary transfer roller 5*a*, a DC voltage positive (+) is applied, so that the toner image on the photosensitive drum 2*a* passing through the primary transfer portion Ta is transferred onto the intermediary transfer belt 8. The drum cleaning device 6*a* causes its cleaning blade to contact the photosensitive drum 2*a* to collect the transfer residual toner which passes through the primary transfer portion Ta and then is deposited on the photosensitive drum 2*a*.

<Intermediary Transfer Belt>

The intermediary transfer belt 8 is extended around and supported by an opposite roller 10, a driving roller 59 and a tension roller 11, and is driven by the driving roller 59 to be rotated in an arrow R2 direction. The driving roller 59 is provided at a position remote horizontally from the tension roller 11. The intermediary transfer belt is constituted by a film or the like of a dielectric resin material such as polycarbonate, polyethylene terephthalate or polyvinylidene fluoride.

The secondary transfer roller 12 contacts an outer surface of the intermediary transfer belt 8 supported by the opposite roller 10 at an inner surface of the intermediary transfer belt 8, thus forming the secondary transfer portion T2 between itself and the intermediary transfer belt 8. A belt cleaning device 13 includes a cleaning blade contacted to the outer surface of the intermediary transfer belt 8 supported by the tension roller 11 at the inner surface of the intermediary transfer belt 8. The belt cleaning device 13 rubs the intermediary transfer belt 8 with the cleaning blade, thus collecting the transfer residual toner which passes through the secondary transfer portion T2 and is deposited on the surface of the intermediary transfer belt.

<Controller>

Figure 2:
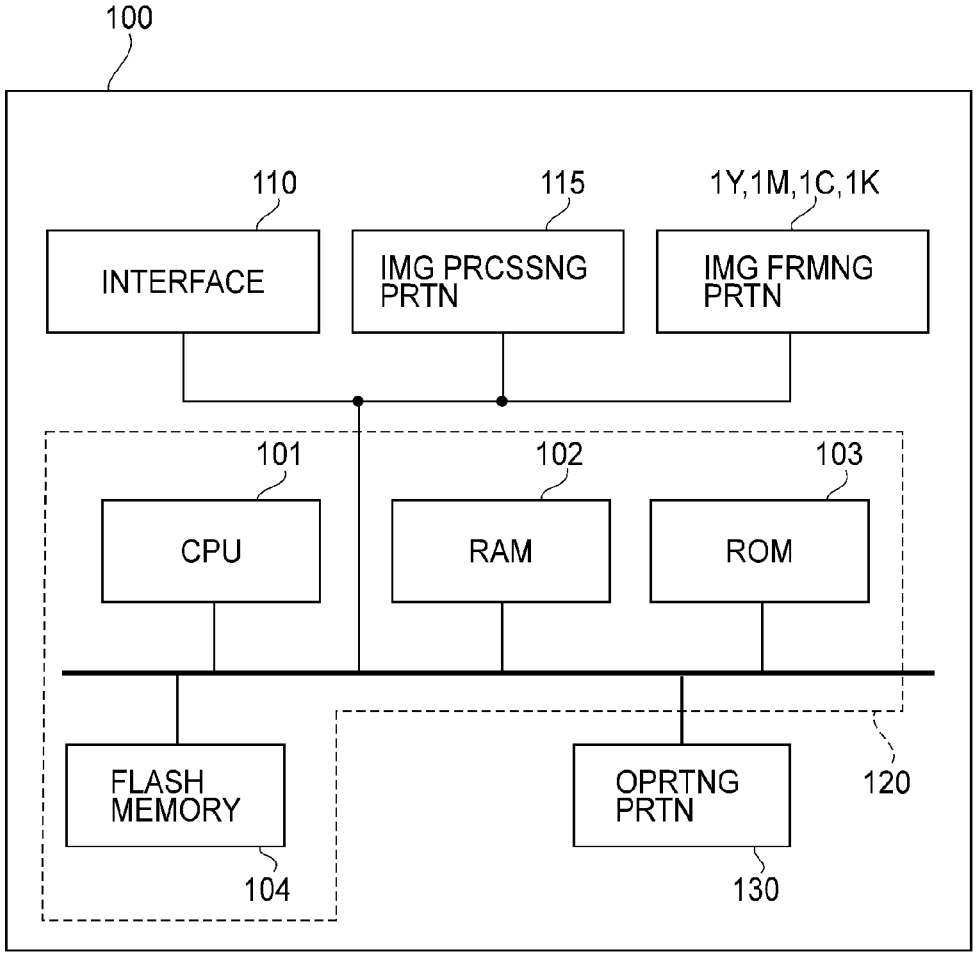
FIG. 2 is a block diagram of a control system of an image forming apparatus 100.

FIG. 2 is a block diagram of a control system of the image forming apparatus 100. A controller 120 controls the image forming apparatus 100. An interface portion 110 permits input of the image data. An image processing portion 115 effects image processing of the inputted image data. Each of the image forming portions 1Y, 1M, 1C and 1K effects the image formation on the basis of the processed image data. The controller 120 controls each of the image forming portions 1Y, 1M, 1C and 1K to form the image on the recording material.

CPU 110 executes a program to effect control of each of the portions. RAM 102 temporarily stores data to ensure an execution region of the program. ROM 103 stores the program, initial set values, a patch pattern image for density detection described later, and the like. Flash memory 104 stores various set values.

An operating portion 130 is constituted by a liquid crystal monitor screen where an operation through a touch panel is enabled, and receives input by a user. The operating portion 130 may also be constituted by an input terminal (PC) or the like externally connected with the image forming apparatus 100.

<Primary Transfer Portion>

Figure 3:
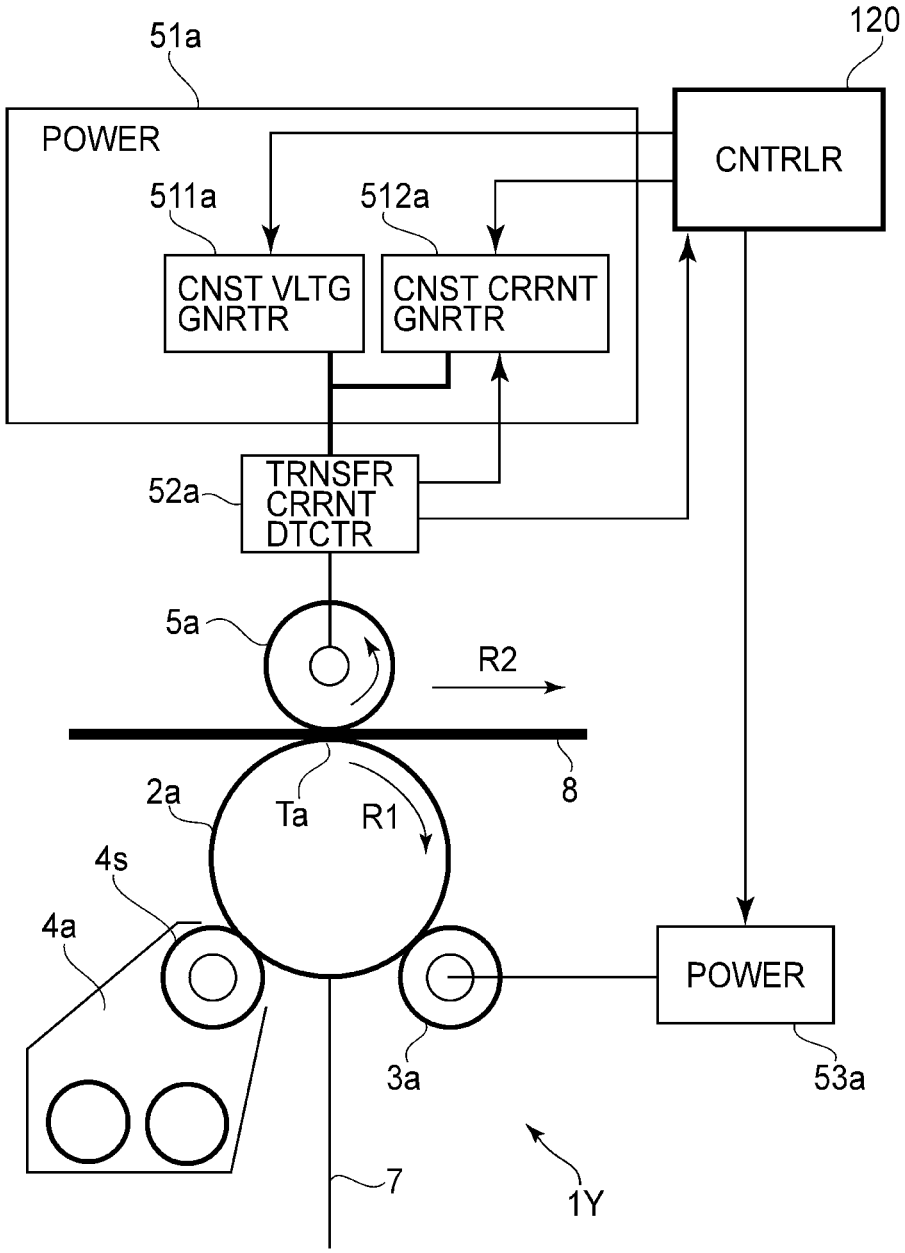
FIG. 3 is an illustration of a primary transfer portion of a yellow image forming portion.

FIG. 3 is an illustration of the primary transfer portion of the yellow image forming portion. As shown in FIG. 3, the photosensitive drum 2*a* is rotated in the arrow R1 direction, and the intermediary transfer belt 8 is rotated in the arrow R2 direction. The primary transfer roller 5*a* is prepared by forming an elastic layer around a metal-made rotation shaft. The elastic layer is constituted by a sponge texture of a rubber material in which an ion-conductive agent is mixed.

The primary transfer roller 5*a* forms the primary transfer portion Ta between the intermediary transfer belt 8 and the photosensitive drum 2*a* by being urged toward the rotation shaft of the photosensitive drum 2*a* by an unshown spring member at its end portions. A power source 51*a* applies a DC voltage of a positive polarity to the primary transfer roller 5*a* in synchronism with toner image passing timing, thus electrically charging the photosensitive drum 2*a* to a positive potential relative to the photosensitive drum 2*a*. As a result, the toner particles which are negatively, charged and are carried on the photosensitive drum 2*a* are attracted to the intermediary transfer belt 8.

The power source 51 is constituted by a constant voltage generating circuit 511*a* and a constant current generating circuit 512*a* is capable of setting control of the transfer voltage to be applied to the primary transfer roller 5*a* so as to switch between constant voltage control and constant current control.

The primary transfer roller 5*a* is connected to a primary transfer current detecting circuit 52*a*. The primary transfer current detecting circuit 52 is constituted by a voltage (potential)-dividing circuit for generating an analog voltage depending on the transfer current flowing from the power source 51*a* into the primary transfer roller 5*a*, an amplifying circuit for amplifying the analog voltage, and an AD converter for converting the amplified analog voltage into a digital data.

The controller 120 applies a predetermined transfer voltage from the constant voltage generating circuit 511*a* to the primary transfer roller 5*a* during ATVC, thus obtaining an output of the primary transfer current detecting circuit 52*a* to measure the transfer current. The controller 120 sets, on the basis of a measurement result of the transfer current, a constant transfer voltage to be applied to the primary transfer portion Ta during the image formation. The controller 120 outputs, during the image formation, the constant voltage set by controlling the constant voltage generating circuit 511*a*, so that the toner image is transferred from the photosensitive drum 2*a* onto the intermediary transfer belt 8.

The analog voltage is fed back from the primary transfer current detecting circuit 52*a* to the constant current generating circuit 512*a*, so that the constant current generating circuit 512*a* fluctuates an output voltage so as to output a constant current value designated by the controller. For this reason, even when a resistance value of the primary transfer roller 5*a* and a contact state or the like at the primary transfer portion Ta are changed, a transfer current in a certain range flows into the primary transfer portion Ta via the primary transfer roller 5*a*.

However, there is a limit for a response speed of the constant current generating circuit 512*a* and therefore a fluctuation in transfer voltage outputted by the constant current generating circuit 512*a* is large, so that the transfer current is stabilized in the case where the constant voltage generating circuit 511*a* outputs the transfer voltage.

<ATVC>

Figure 4:
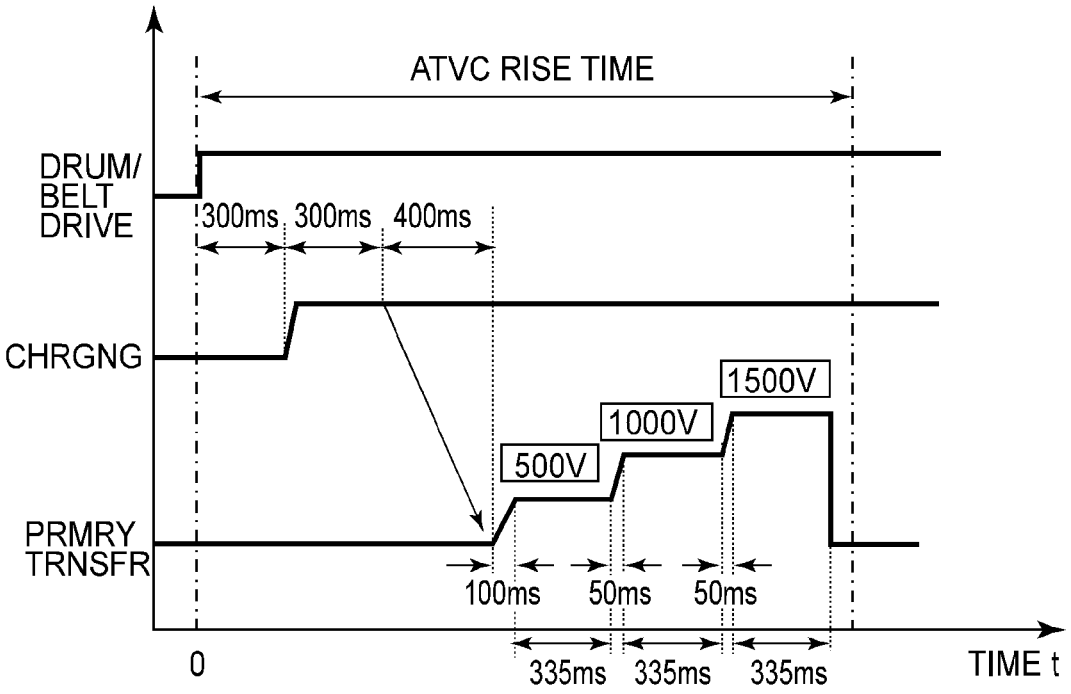
FIG. 4 is a time chart of ATVC at the primary transfer portion.
Figure 5:
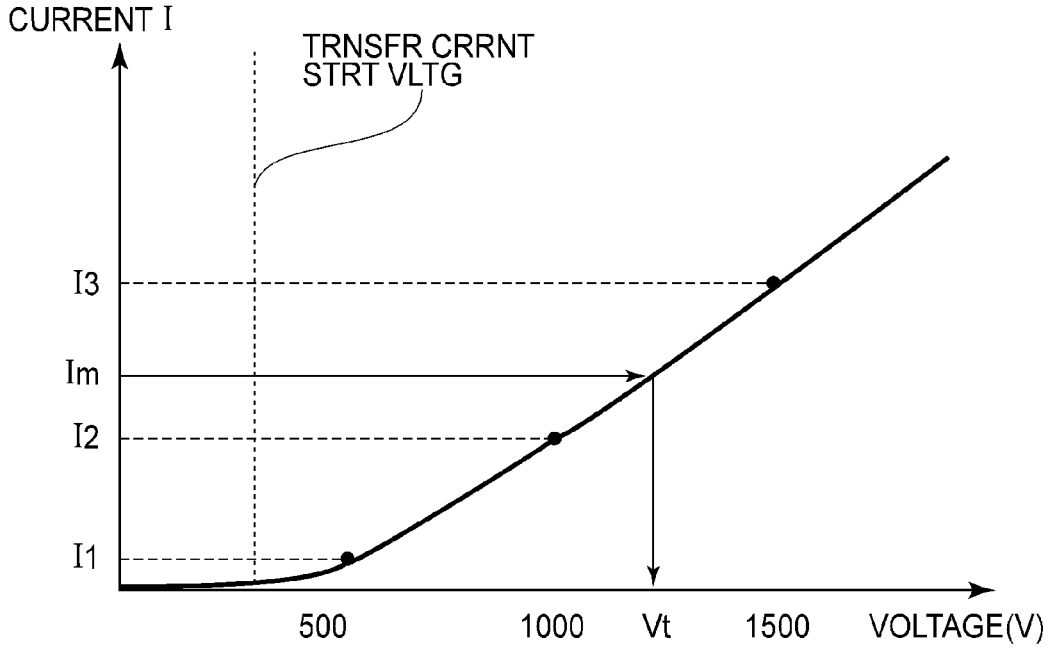
FIG. 5 is an illustration of a measurement result of a transfer current in the ATVC.

FIG. 4 is a time chart of the ATVC at the primary transfer portion. FIG. 5 is an illustration of the transfer current measurement result in the ATVC. Generally, at the primary transfer portion of the image forming apparatus an elastic sponge roller having the advantages of ozone less, low cost and the like has been used in many cases. However, it is difficult to suppress a variation in resistance of the elastic sponge roller during manufacturing and in addition, the resistance is changed depending on a change in ambient temperature and humidity, a deterioration by continuous use.

For that reason, in the image forming apparatus 100, as a method of maintaining a transfer property in primary transfer bias control irrespective of the roller resistance variation, an operation embodiment and an operation state, the ATVC (active transfer voltage control) is executed. In the ATVC, as bias control during application of the transfer bias from the transfer bias application power source to the transfer roller at the time of the transfer, the current is carried into the transfer nip during non-image formation and then an optimum transfer bias is set from current and voltage values at that time. In the ATVC, the voltage applying means and a detecting means for detecting the current are connected. Then, predetermined voltages (two or more voltages) are applied to the transfer bias application power source, so that a relational expression between the voltage and the current is obtained. From the relational expression, a voltage value providing a target current value is calculated so that when the toner image on the photosensitive drum is transferred, the constant voltage control is effected at the transfer voltage obtained in advance.

As shown in FIG. 3, the controller 120 executes the ATVC to set the transfer voltage to be applied to the primary transfer roller 5*a* during the image formation. Execution timing of the ATVC is (1) every cumulation of image formation of a certain number of sheets, (2) the case where the ambient temperature and humidity are largely fluctuated, and (3) during main switch actuation (during discrimination at the start of the day). In the ATVC, the controller 120 rotates the photosensitive drum 2*a* and the intermediary transfer belt 8 and then applies, with rotation-stabilized timing, an oscillating voltage in the form of the DV voltage VD biased with the AC voltage Vac, thus electrically charging the surface of the photosensitive drum 2*a* to the dark portion potential VD.

As shown in FIG. 4, the controller 120 applies DC voltages of a plurality of levels to the primary transfer roller 5*a* when a region where the photosensitive drum 2*a* is charged to the dark portion potential VD reaches the primary transfer portion Ta. In this case, to the primary transfer roller 5*a*, the voltages of three levels of 500 V, 1000 V and 1500 V are successively applied. In FIG. 4, "400 msec" is a time of rotation of the photosensitive drum 2*a* from a contact position to the charging roller 3*a* to the primary transfer portion Ta.

The controller 120 obtains an output of the primary transfer current detecting circuit 52*a* at each of stages in which the DC voltages of the plurality of levels are applied to the primary transfer roller 5*a*, thus measuring the transfer current flowing through the primary transfer roller 5*a*. In this way, a transfer current I1 when 500 V is applied to the primary transfer roller 5*a*, a transfer current I2 when 1000 V is applied to the primary transfer roller 5*a*, and a transfer current I3 when 1500 V is applied to the primary transfer roller are measured.

As shown in FIG. 5, the transfer currents I1, I2 and I3 become a large value with an increasing transfer voltage applied to the primary transfer roller 5*a*. A current-voltage characteristic at the primary transfer portion Ta shows linearity (proportional relationship) in a voltage range exceeding a "transfer current start voltage" indicated by a vertical broken line.

The controller 120 uses this linearity and, in the ATVC, linearly plots current-voltage data detected when the voltage of the above-described three levels are applied, thus effecting interpolation operation (computing) of a transfer voltage Vt providing a desired transfer current Im. Then, the controller 120 resumes the image formation after setting the calculated transfer voltage Vt. Alternatively, the image forming apparatus enters a stand-by state of the image formation.

In the stand-by state, the rotation operation and the voltage application at the image forming portion are in the on-state, and the heating operation of the fixing device is also in the on-state. For that reason, the image forming operation can be started immediately.

<ATVC Execution Time>

During execution of the ATVC, a time to some extent is required. Specifically, the time includes a rise time of the charging voltage applied to the charging roller 3*a* in order to set a potential difference (transfer contrast, between the primary transfer roller 5*a* and the photosensitive drum 2*a*, under the same condition as that during the image formation. The time includes a time until the potential of the charged photosensitive drum 2*a* is stabilized. The time includes a rise time of the transfer voltage to be applied to the primary transfer roller 5*a*, a transfer current measuring time, and a time required for calculating the transfer voltage during the image formation from the measured relationship between the transfer voltage and the transfer current.

In this embodiment, the photosensitive drum 2*a* is 150 mm/sec in peripheral speed (process speed) and 30 mm in diameter, and the primary transfer roller 5*a* is 16 mm in diameter and therefore the execution time of the ATVC is as follows. A time from start of the charging by the charging roller 3*a* until the region of the charged photosensitive drum 2*a* reaches the primary transfer portion Ta is 1000 msec. The rise time of the transfer voltage to be applied to the primary transfer roller 5*a* is 100 msec. In view of resistance non-uniformity of the primary transfer roller 5*a*, the transfer current is measured through one full turn of the primary transfer roller 5*a* and therefore the transfer current measuring time is 335 msec at each of the three levels of the applied voltage and thus about 1000 msec in total. A switching time between the two levels of the voltage of the three levels is 50 msec. A computing time of the set value of the transfer voltage after the measurement of the transfer current of the three levels is several psec and thus is neglected. From the above, a total control time of the ATVC is 2.2 sec.

Thus, the ATVC requires the time to same extent and therefore the timing when the ATVC is executed is limited to during the rise of the main power source, during the detection of embodiment fluctuation by the embodiment sensor, and every predetermined number of sheets (e.g., 1000 sheets) during the image formation. As a result, the ATVC is not effected every image formation and every image forming job, so that a down time of the image forming apparatus is reduced. Further, at an interval between the ATVC and subsequent ATVC, the transfer voltage is set by making reference to the last ATVC and therefore in an ordinary case, a transfer efficiency of the toner image at the primary transfer portion Ta can be kept at a constant level.

<Transition from Sleep State to Stand-By State>

The image forming apparatus 100 is in a stand-by state, in which the image forming apparatus 100 can execute the image formation immediately after input of a subsequent job, after main switch actuation and then various main assembly rising control operations including the ATVC are executed or then an image forming job is performed. Here, when a time in which the subsequent image forming job is not performed exceeds a predetermined time, the image forming apparatus 100 enters a sleep state, in which electric power consumption is suppressed, while keeping the main switch actuation state in order to save electric power. The image forming apparatus 100 positively uses the sleep state from the viewpoint of power saving.

The sleep state corresponds to a non-operational mode, of a system, to which the mode of the image forming apparatus is automatically switched in the case where the operation or the input of the image forming job is stopped for a predetermined time. In the sleep state, in order to suppress the electric power consumption, electric power is supplied to only a necessary minimum circuit and also the controller 120 lowers a clock frequency of the CPU 101. Then, during the sleep state, when the input of the image forming job or a key operation is performed, the power source of the apparatus main assembly is actuated again and thus the mode of the image forming apparatus 100 is returned to a normal operation mode in which a normal operation such as printing can be performed, so that the system is actuated.

With respect to the transition from the sleep state to the stand-by state, a time in which the image forming apparatus 100 is left standing is uncertain and therefore various embodiment changes would be assumed.

Correspondingly thereto, as a preventive measure, it is preferable that the ATVC for optimizing a main assembly condition is executed during the transition from the sleep state to the stand-by state. This is because at the primary transfer portion Ta, when the ATVC is executed, optimization of the transfer voltage corresponding to fluctuation in main assembly embodiment can be performed and thus a good image can be obtained.

However, in the case where the ATVC is effected in discriminately, even when there is almost no fluctuation at the calculated transfer voltage, a down time accompanying the ATVC is generated. Correspondingly to the time of the ATVC, the down time is generated during the transition from the sleep state to the stand-by state and therefore the generation of the down time is not preferred from the viewpoint of usability.

If down time reduction has priority during the transition from the sleep state to the stand-by state and the ATVC is not effected, the transfer voltage calculated in the last effected ATVC is applied to the primary transfer roller 5*a*.

In this case, when the embodiment change is largely generated during the sleep state of the image forming apparatus 100, the resistance value of the primary transfer roller 5*a* is changed to a value different from that during the last effected ATVC. For this reason, when the transfer voltage calculated in the last effected ATVC is applied, a value of a current passing through the primary transfer portion Ta is changed, so that an improper transfer image is generated due to the change.

This phenomenon occurs even in the case where the embodiment condition is not changed. In this case, when an intermediary transfer unit including the intermediary transfer belt 8 and the primary transfer roller 5*a* is replaced, the resistance change of the primary transfer roller 5*a* is generated. Between the intermediary transfer unit which ends its lifetime and is to be replaced and a fresh intermediary transfer unit, a difference in resistance value of the primary transfer roller 5*a* is large, so that when the same transfer voltage is applied, the transfer current largely deviates from an optimum current value.

Therefore, in the following embodiments, in the case where image output having suppressed the generation of the down time has priority, when the state of the image forming apparatus is shifted to the sleep state and then is restored to the normal state to effect the image formation, the ATVC is not effected but the primary transfer bias application by the constant current control is effected to perform the image forming operation.

<Embodiment 1 >

Figure 6:
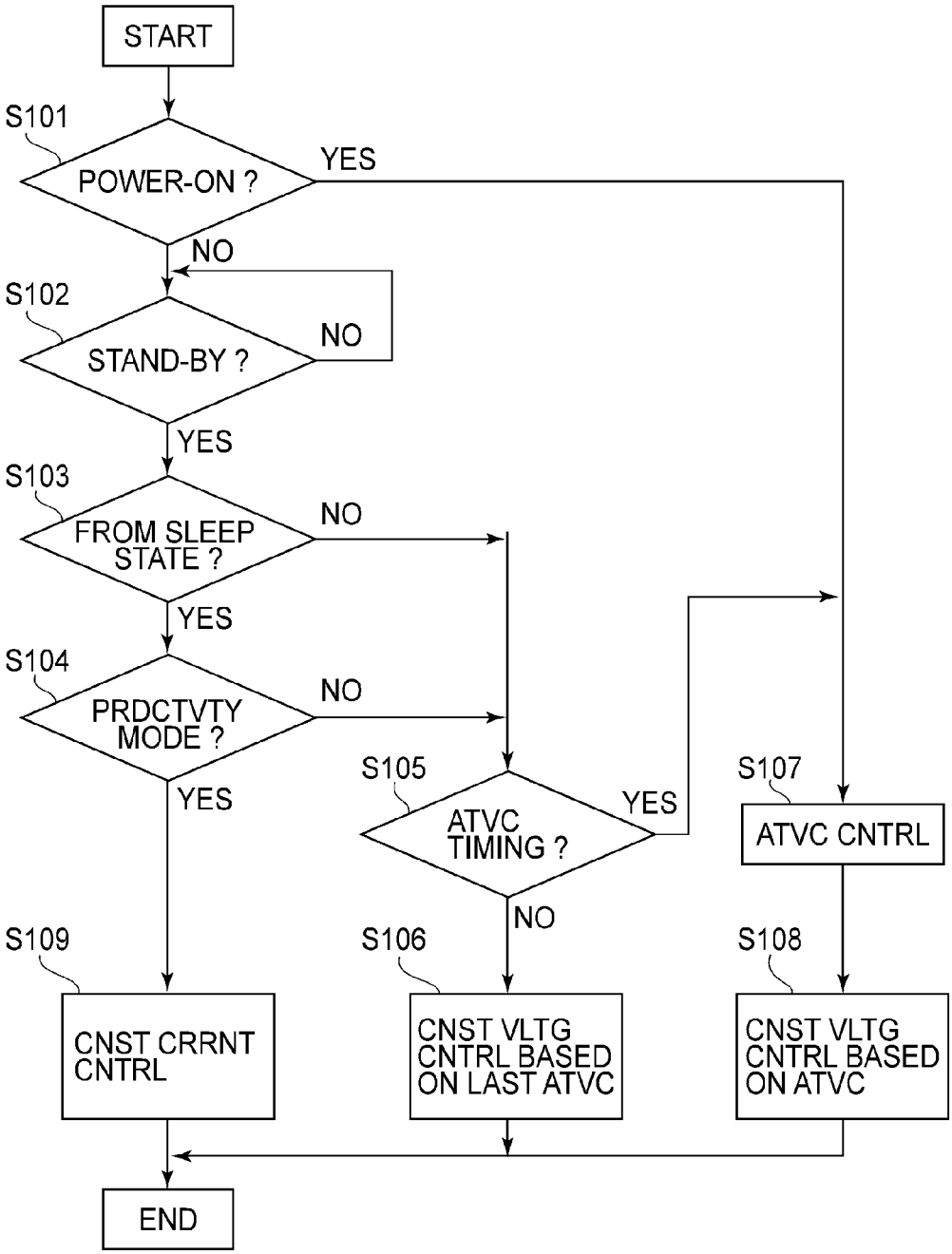
FIG. 6 is a flow chart of the ATVC in Embodiment 1.

FIG. 6 is a flow chart of the ATVC. As shown in FIG. 2, a service person causes a setting screen to be displayed on the operating portion 130 during setup of the image forming apparatus 100 and sets, in a switching manner, a productivity priority mode in which the down time reduction has priority and an image quality priority mode in which the down time reduction does not have priority. The switching may also be freely made by a user after the setting by the service person.

As shown in FIG. 3, the primary transfer roller 5*a* as an example of the transfer member is contacted to the intermediary transfer belt 8 as an example of the intermediary transfer member to form the intermediary transfer portion Ta as an example of the toner image transfer portion. The controller 120 as an example of the control means is capable of selectively executing one of the constant voltage control accompanied with the ATVC as an example of a first mode and the constant current control as an example of a second mode. The controller 120 executes the constant voltage control accompanied with the ATVC every during the main switch actuation of the apparatus and every image formation of a predetermined number of sheets (prints).

In the constant voltage control accompanied with the ATVC, the transfer current is measured by applying the constant voltage to the primary transfer roller 5 at a plurality of predetermined levels and thereafter the transfer voltage (constant voltage) on the basis of a measurement result is applied to the primary transfer roller 5. On the other hand, in the constant current control, the transfer voltage subjected to the constant current control with a predetermined current value is applied to the primary transfer roller 5.

The controller 120 executes the constant current control in an image forming job executed after the rotation of the photosensitive drum 2 is stopped when the time in which the image formation is not effected exceeds a predetermined time, and then the transition from the sleep state, in which the electric power of the apparatus main assembly is lowered, to the stand-by state.

The operating portion 130 as an example of a setting means is capable of setting, in a switching manner, the constant voltage control accompanied with the ATVC as the example of the first mode and the constant current control as the example of the second mode by a manual operation. When the productivity priority mode is manually set at the operating portion 130, the controller 120 applies the constant current-controlled transfer voltage to the primary transfer roller 5*a* during the transition from the sleep state to the stand-by state.

As shown in FIG. 6 with reference to FIG. 3, the controller 120 discriminates whether or not the main assembly is in a state immediately after the main switch calculation (S101). In the case of the state immediately after the main switch actuation (YES of S101), the ATVC is effected (S107). In the case where the main assembly is not in the state immediately after the main switch actuation (NO of S101), the controller 120 discriminates whether or not the main assembly state is the stand-by state (S102).

In the case of the stand-by state (YES of S102), the controller 120 discriminates whether or not the stand-by state is shifted from the sleep state (S103). In the case of the transition from the sleep state (YES of S103), the controller discriminates whether or not the productivity priority mode is set (S104). In the case of the setting of the productivity priority modes (YES of S104), the ATVC is not effected and the image formation by the constant current control is effected (S109).

In the case where the stand-by state is not shifted from the sleep state (NO of 5103) or in the case where the productivity priority mode is not set (NO of S104), the normal image formation by the constant voltage control is effected (S105 to S108).

In the normal image formation by the constant voltage control, the controller 120 discriminates whether or not the timing is ATVC execution timing (S105). In Embodiment 1, the ATVC execution timing is the case where a (next) job after 100 sheets are passed after the last ATVC is performed or the case where the main assembly embodiment sensor detects the fluctuation.

In these two cases, the timing is discriminated as the ATVC execution timing (YES of S105), so that the ATVC is effected (S107), and then the constant voltage set by the ATVC is set as the transfer voltage and thereafter the primary transfer of the toner image by the constant voltage control is executed (S108). In the case where the timing is not the above two cases, the discrimination that the timing is not the ATVC execution timing is made (NO of S105), and the constant voltage determined in the last effected ATVC is set at the transfer voltage and then the toner image transfer by the constant voltage control is executed (S106).

Incidentally, as shown in FIG. 1, with respect to the setting of the constant voltage to be applied to the secondary transfer roller 12 as an example of the secondary transfer member, there is a sufficient time from job start until a leading end of the toner image transferred on the intermediary transfer belt 8 reaches the secondary transfer portion T2. For this reason, after the application of the transfer voltage, subjected to the constant current control, to the primary transfer roller 5*a*, the ATVC at the secondary transfer portion T2 is effected.

The constant current set during the transfer of the toner image for an image in the constant current control is referred to as a target current. In the case where the constant current control is effected at the primary transfer portion Ta, first, there is a need to determine the target current as a target of the control. The target current is obtained from an embodiment table, to which reference is made when the applied voltage is determined in the ATVC, in which the target current is determined every image of an absolute humidity of ambient air. Table 1 is the embodiment table of the target current to which reference is made when the constant current control is effected.

TABLE 1

| | AWC*1 (g/m$^3$) | | | | | | | |
|---|---|---|---|---|---|---|---|---|
| | 1.1 | 3 | 5.9 | 8.9 | 12 | 15.9 | 18.1 | 21.7 |
| TC*2 (μA) | 20 | 19.5 | 19 | 19 | 19 | 18.5 | 18.5 | 18 |

*1"AWC" represents an absolute water content.
*2"TC" represents the target current.

From an output of a temperature and humidity sensor provided in the apparatus main assembly of the image forming apparatus 100, the absolute water content of ambient air is obtained and then the target current is determined by making reference to the embodiment table with respect to the absolute water content as shown in Table 1. The transfer voltage to be applied to the primary transfer roller 5*a* may only be required such that the constant voltage value rises before the formed toner image reached the primary transfer portion Ta, and therefore the timing thereof is the same as that in the normal constant voltage control.

As described above, in the case where the ATVC is effected (S107 and S108), 2.2 sec is required until the transfer voltage is applied to the primary transfer roller 5*a*. On the other hand, in the case where the constant current control is effected (S109), the toner image transfer by the constant current control can be started immediately after the charge potential-stabilized region of the photosensitive drum 2*a* reaches the primary transfer portion Ta and therefore it takes about 1.0 sec. Therefore, compared with the execution of the ATVC (S107, S108), down time reduction of about 1.2 sec was able to be achieved.

According to Embodiment 1, in the case where the image output having suppressed the generation of the down time has priority, when the image is formed after the transition from the sleep state to the stand-by state, the ATVC is not effected, and the transfer voltage to be applied to the primary transfer roller 5*a* is controlled by the constant current control. During the transition from the sleep state to the stand-by state, even when the set value of the applied voltage to the primary transfer roller 5*a* is not optimized, by effecting the image formation by using the constant current control, it is possible to effect the image formation without generating the down time of the main assembly.

<Embodiment 2>

In Embodiment 1, during the transition from the sleep state to the stand-by state, the image formation is effected by the constant current control. However, from the viewpoint of the transfer efficiency, in the case where the image formation is continued also after the transition from the sleep state to the stand-by state, it is desirable that the control is returned early to the constant voltage control. For that reason, in this embodiment, the ATVC is effected in a job next to a job after the sheet passing by the constant current control is ended, and thereafter only the constant voltage control was effected.

<Embodiment 3>

Figure 7:
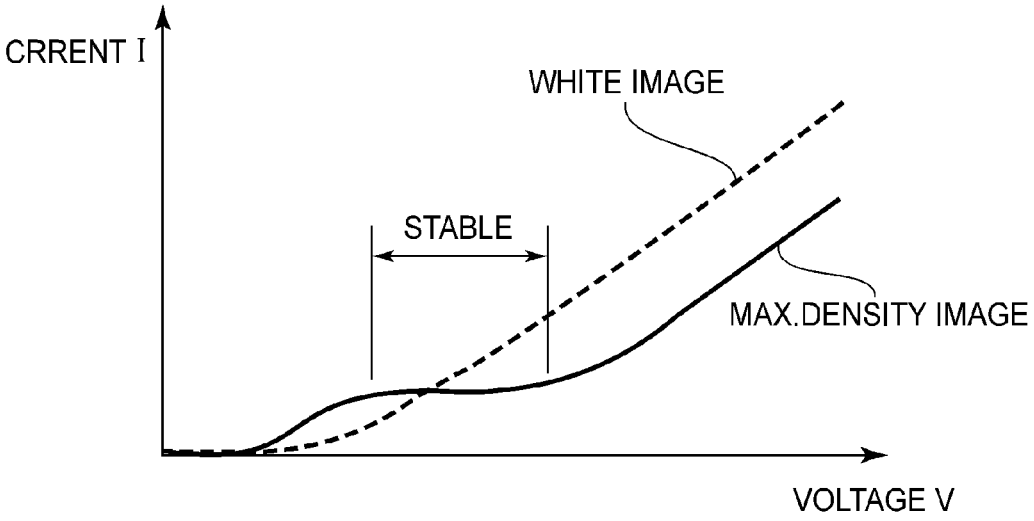
FIG. 7 is an illustration of a transfer voltage-transfer current characteristic in the case where the toner image is transferred.

FIG. 7 is a graph for illustrating a transfer voltage-transfer current characteristic in the case where the toner image is transferred. Parts (a) and (b) of FIG. 8 are graphs for illustrating a change in target current accompanying a change in ambient temperature and humidity. Parts (a), (b) and (c) of FIG. 9 are illustrations of optimization of the transfer current by the constant current control.

As shown in FIG. 6, in Embodiment 1, under the setting in which the down time reduction has priority (YES of S103), during the transition from the sleep state to the stand-by state (YES of S102), the ATVC is not effected, and the image forming operation is performed by the constant current control (S109). In this embodiment, the reason therefor will be described.

As shown in FIG. 7, the transfer voltage-transfer current characteristic is changed between the case where the toner image is transferred and the case where the toner image is not transferred. In the figure, a broken line represents during transfer of a white image with no transfer of the toner image, and a solid line represents during transfer of a whole area maximum density image with which the toner image is transferred in a large amount. In the case where the toner image is transferred, even when the transfer voltage is fluctuated, there is a stable region in which the transfer current is not changed.

Even in the constant voltage control and in the constant current control, a high-voltage output varies to some extent although it depends on a performance of the high-voltage source. For that reason, a variation in voltage control of the apparatus can be absorbed by effecting the constant voltage control to use the stable region of the current, so that the transfer efficiency is stably ensured and thus it is possible to alleviate degrees of non-uniformity and variation of the output image density.

As shown in (a) and (b) of FIG. 8, in a high-temperature and high-humidity embodiment, compared with a normal temperature and normal-humidity embodiment, the resistance value of the primary transfer roller is lowered, so that there is a tendency to increase the transfer current with respect to the same transfer voltage set value A. In the high-temperature and high-humidity embodiment, the temperature is 30° C. and the humidity is 80% RH. In the normal-temperature and normal-humidity embodiment, the temperature is 23° C. and the humidity is 50% RH.

Depending on the change in ambient temperature and humidity, the resistance of the primary transfer roller is changed, and depending on the change in resistance, the transfer voltage-transfer current relationship (characteristic) is also changed. Therefore, a curve obtained by plotting the transfer currents and the transfer voltages is shifted. For this reason, if the set value A of the transfer voltage to be applied to the primary transfer portion T1 is not changed in that state, in a state of the high-temperature and high-humidity embodiment, an excessive current flows into the primary transfer portion T1, so that an improper transfer image is generated.

As shown in (a) of FIG. 8, the change in transfer current during the transfer of a white background image (solid white image) is larger than that during the transfer of the whole area maximum density image (solid black image) shown in (b) of FIG. 8, and therefore transfer failure becomes more conspicuous in a high-light side, where a toner amount per unit area is small, than in a high image density side.

Therefore, when the embodiment change between during the transition from the stand-by state to the sleep state and during the transition from the sleep state to the stand-by state is large, the change in resistance of the primary transfer roller 5*a* becomes non-negligible. In the case where the ATVC is not effected during the transition from the sleep state to the stand-by state, when the transfer voltage of the set value A which was applied to the primary transfer roller 5*a* before the change in embodiment is applied to the primary transfer roller 5*a*, the improper transfer is generated.

However, when the constant current control is effected in this case, the current flowing into the primary transfer portion Ta is closer to the target current than that in the case where the constant voltage control output is performed at the set value A during the transition from the sleep state to the stand-by state. However, the transfer current is fluctuated within a variation range of the constant current control by the main assembly.

Part (a) of FIG. 9 shows waveforms of the voltage and the current when the primary transfer is effected by the constant voltage control after the ATVC is effected before the embodiment change is actually generated in the apparatus. As shown in (a) of FIG. 9, in the case where the constant voltage control is effected after the ATVC, the transfer current is stabilized. A fluctuation ΔI of the transfer current at that time was 0.5 μA to 1.0 μA.

Part (b) of FIG. 9 shows waveforms of the voltage and the current when the primary transfer is effected by the constant current control. As shown in (b) of FIG. 9, in the case where the constant current control is effected without effecting the ATVC during the transition from the sleep state to the stand-by state, the fluctuation ΔI of the transfer current is 1.0 μA to 1.5 μA which are somewhat larger than those in the case of the constant voltage control. However, an average of difference values between the transfer current I and the target current Im is approximately 0 μA, and therefore there was no large defect in the outputted image.

Part (c) of FIG. 9 shows waveforms of the voltage and the current when the primary transfer is effected by the constant voltage control. As shown in (c) of FIG. 9, in the case where the constant voltage control is effected, at the set value A during the transition to the sleep state, without effecting the ATVC during the transition from the sleep state to the stand-by state, the set value A of the transfer current is deviated from a proper range by transition of the embodiment from the normal-temperature and normal-humidity embodiment to the high-temperature and high-humidity embodiment. At this time, the fluctuation ΔI is 0.5 μA to 1.0 μA which are small, but the transfer current becomes larger than the target current by approximately 4.0 μA to 4.5 μA. Therefore, due to the excessive transfer current, the improper transfer image was generated.

From this result, it was confirmed that in order to effect the image formation without effecting the ATVC when the fluctuation in temperature and humidity was generated in the sleep state, the constant current control was more effective than the constant voltage control. Even in the case where the ATVC is not effected when the fluctuation in temperature and humidity is generated during the restoration to the stand-by state, the change in current can be minimized by effecting the constant current control, so that it is possible to effect the image formation without generating the down time.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 019707/2012 filed Feb. 1, 2012 and 277996/2012 filed Dec. 20, 2012, which is hereby incorporated by reference.

What is claimed is:

1. An image forming apparatus comprising:

a rotatable image bearing member;

a toner image forming portion for forming a toner image on said image bearing member;

an intermediary transfer member rotatable in contact with said image bearing member;

a transfer member for transferring the toner image from said image bearing member onto said intermediary transfer member at a transfer portion;

an executing portion configured to execute an operation in a first mode in which a transfer voltage on the basis of a current detected when a predetermined voltage is applied to said transfer member at predetermined timing in advance of image formation is applied to said transfer member to effect the image formation, and configured to execute an operation in a second mode in which a transfer voltage is applied to said transfer member so as to provide a predetermined constant current value to effect the image formation; and a controller configured to make transition of a state of said image forming apparatus between a stand-by state in which the image formation is enabled and a sleep state in which electric power consumption is less than that in the stand-by state, wherein said controller executes the operation in the first mode in an image forming job after main switch actuation of a main assembly of said image forming apparatus and before said controller makes the transition of the state of said image forming apparatus to the sleep state; and a setting portion, operable by an operator, configured to set a productivity-priority mode in which down time reduction has priority and an image quality-priority mode in which an image quality has priority, wherein said setting portion causes said controller to execute, when the productivity-priority mode is selected, the operation in the second mode in an initial image forming job after the transition from the sleep state to the stand-by state and to execute, when the image quality-priority mode is selected, the operation in the first mode in the initial image forming job.

2. An image forming apparatus according to claim 1, further comprising an environment sensor for detecting ambient temperature and humidity of the main assembly, wherein even in the case where the image quality-priority mode is selected at said setting portion, when a difference between an output of said environment sensor in the sleep state and an output of said environment sensor in the stand-by state is a predetermined voltage or more, said controller executes the operation in the first mode.

3. An image forming apparatus according to claim 1, further comprising an environment sensor for detecting ambient temperature and humidity of the a main assembly, wherein said controller executes the operation in the second mode at a constant current value depending on an output of said environment sensor.

4. An image forming apparatus comprising:

a rotatable image bearing member;

a toner image forming portion for forming a toner image on said image bearing member;

an intermediary transfer member rotatable in contact with said image bearing member;

a transfer member for transferring the toner image from said image bearing member onto said intermediary transfer member at a transfer portion;

an executing portion configured to execute an operation in a first mode in which a transfer voltage on the basis of a current detected when a predetermined voltage is applied to said transfer member at predetermined timing in advance of image formation is applied to said transfer member to effect the image formation, and configured to execute an operation in a second mode in which a transfer voltage is applied to said transfer member so as to provide a predetermined constant current value to effect the image formation;

a controller configured to make transition of a state of said image forming apparatus between a stand-by state, during which, after an image forming signal is input, the controller starts the image forming job, and a sleep state, during which, after the image forming signal is input, said controller makes the transition in the stand-by state and starts the image forming job, and in which electric power consumption is less than that in the stand-by state, wherein said controller executes the operation in the first mode in a first image forming job after the image forming signal is input during the stand-by state; and a setting portion, operable by an operator, configured to set a productivity-priority mode in which down time reduction has priority and an image quality-priority mode in which an image quality has priority, wherein in a first image forming job after the image forming signal is input during the sleep state, said setting portion causes said controller to execute the operation in the second mode when the productivity-priority mode is selected, and to execute the operation in the first mode when the image quality-priority mode is selected.

* * * * *